US010569182B1

(12) United States Patent
Natarajan et al.

(10) Patent No.: US 10,569,182 B1
(45) Date of Patent: Feb. 25, 2020

(54) NATURE-EMULATING AMUSEMENT DEVICE

(71) Applicants: Vijaya Natarajan, Concord, NH (US); Joanne M. Martin, Concord, NH (US)

(72) Inventors: Vijaya Natarajan, Concord, NH (US); Joanne M. Martin, Concord, NH (US)

( * ) Notice: Subject to any disclaimer, the term of this patent is extended or adjusted under 35 U.S.C. 154(b) by 0 days.

(21) Appl. No.: 16/424,762

(22) Filed: May 29, 2019

(51) Int. Cl.
*A63H 27/00* (2006.01)
*A63H 13/02* (2006.01)

(52) U.S. Cl.
CPC ..... *A63H 13/02* (2013.01)

(58) Field of Classification Search
CPC ..... A63H 13/02
USPC ..... 446/61, 62, 63, 175
See application file for complete search history.

(56) References Cited

U.S. PATENT DOCUMENTS 1,190,343 A * 7/1916 Tyrrell ..... A63H 27/007 446/62
1,785,770 A * 12/1930 Faber ..... F42B 10/56 102/354
2,846,811 A * 8/1958 Polk ..... A63H 3/18 446/365
3,540,149 A * 11/1970 Lowe ..... A63H 27/00 446/67
3,577,670 A * 5/1971 Gutierrez ..... A63H 27/008 446/330
4,292,757 A * 10/1981 Cahen, Jr. ..... A63H 27/007 446/62
4,324,064 A * 4/1982 Bettencourt ..... A63H 27/14 446/64
4,836,817 A * 6/1989 Corbin ..... A63H 27/007 446/42
4,863,413 A * 9/1989 Schwarz ..... A63H 27/007 446/62
4,988,320 A * 1/1991 Rankin ..... A63H 3/003 446/376
5,120,263 A * 6/1992 Ierfino ..... A63H 37/00 273/459
5,394,989 A * 3/1995 Delson ..... A61C 19/008 206/457
5,954,563 A * 9/1999 Spriggs ..... F42B 4/22 102/357
6,247,990 B1 * 6/2001 Moorhouse ..... A63H 27/007 446/45
9,156,301 B2 * 10/2015 Flesher ..... B42D 15/045
2004/0202388 A1 * 10/2004 Rusnak ..... B65F 1/0006 383/71

(Continued)

*Primary Examiner* — Nini F Legesse
(74) *Attorney, Agent, or Firm* — Joanne M. Martin

(57) ABSTRACT

An embodiment of the invention providing a butterfly emulation by a structure including a body and attached wings that are folded, covered, and initially contained in cocoon-like structure, and the user participates in unfolding and establishment of an emerged butterfly. Moreover, the emerged and unfolded butterfly (or other phenomenon of nature) is movable in a life-like motion by the user. Further novel embodiments include different hard and soft covering or containing structures. Such containing structures may also include devices and systems to allow the amusement device to emulate natural phenomenon changes such as the emergence of the butterfly in response to cycles or conditions (e.g. light, sound and/or temperature) sensed from the environment surrounding the butterfly structure, and containing structure.

16 Claims, 5 Drawing Sheets

(56) References Cited

U.S. PATENT DOCUMENTS

2014/0349543 A1* 11/2014 Boujja ..... A63H 3/14
446/73

* cited by examiner

NATURE-EMULATING AMUSEMENT DEVICE

FIELD OF THE INVENTION

The present invention relates to amusement devices having movable parts, in particular to amusement devices that are configurable to resemble and/or emulate occurrences of nature.

BACKGROUND OF THE INVENTION

Amusement devices provide pleasant and enjoyable experiences to those who engage them. Some amusement devices may invite participation and handling of the some aspect or component of the amusement device, but may also require the user to learn rules and present an unnatural challenge or enter into an unnatural context of the amusement device.

Although some amusement device users may prefer a natural or normally occurring amusement experience, many amusement devices demand only a passive involvement by the user and provide no enhanced ultimate experience.

Furthermore, in regard to the over-use of electronic communication or amusement devices that demand focus apart from the environment, some popular amusement devices provide (and demand) an intense interactive experience that often significantly departs from nature or a supportive natural experience, and the user may ultimately be developmentally penalized by the experience.

SUMMARY

The embodiments according to the present invention allow and encourage user participation in a natural context where they can experience natural phenomenon and by interaction, their coming into being.

In one embodiment, a butterfly is emulated by a structure including a body and attached wings that are folded, covered and initially contained in cocoon-like structure, and the user participates in unfolding and establishment of an emerged butterfly. Moreover, the emerged and unfolded butterfly (or other phenomenon of nature) is movable in a life-like motion by the user.

Further novel embodiments include different hard and soft containing structures. Such containing structures may also include devices and systems to allow the amusement device to emulate natural phenomenon such as the emergence of the butterfly in response to cycles or conditions (e.g. light, sound and/or temperature) of the environment surrounding the butterfly and containing structure.

BRIEF DESCRIPTION OF THE DRAWING

These and further features according to the present invention will be better understood by reading the Detailed Description together with the figures of the Drawing, wherein.

DETAILED DESCRIPTION

Figure 1A:
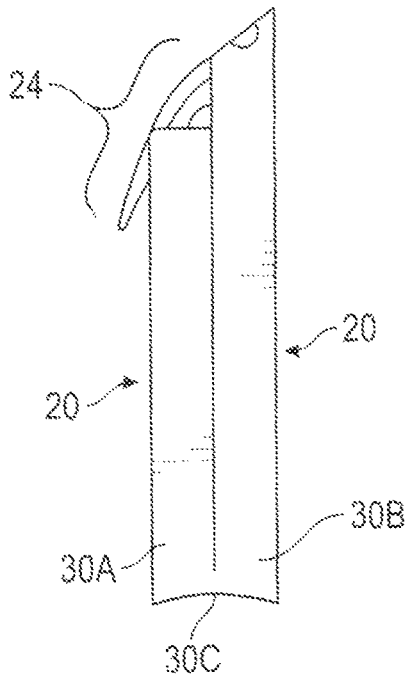
FIG. 1A is an elevation view of a folded butterfly embodiment according to the present invention.
Figure 1B:
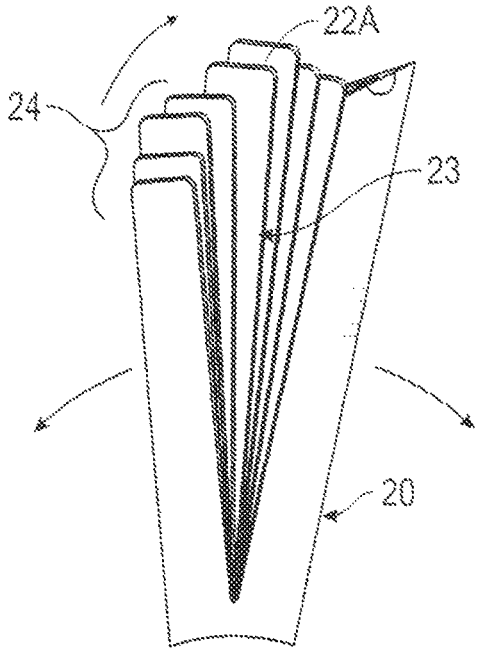
FIG. 1B is a perspective elevation view of a slightly unfolded embodiment according to the present invention embodiment of FIG. 1A.
Figure 1C:
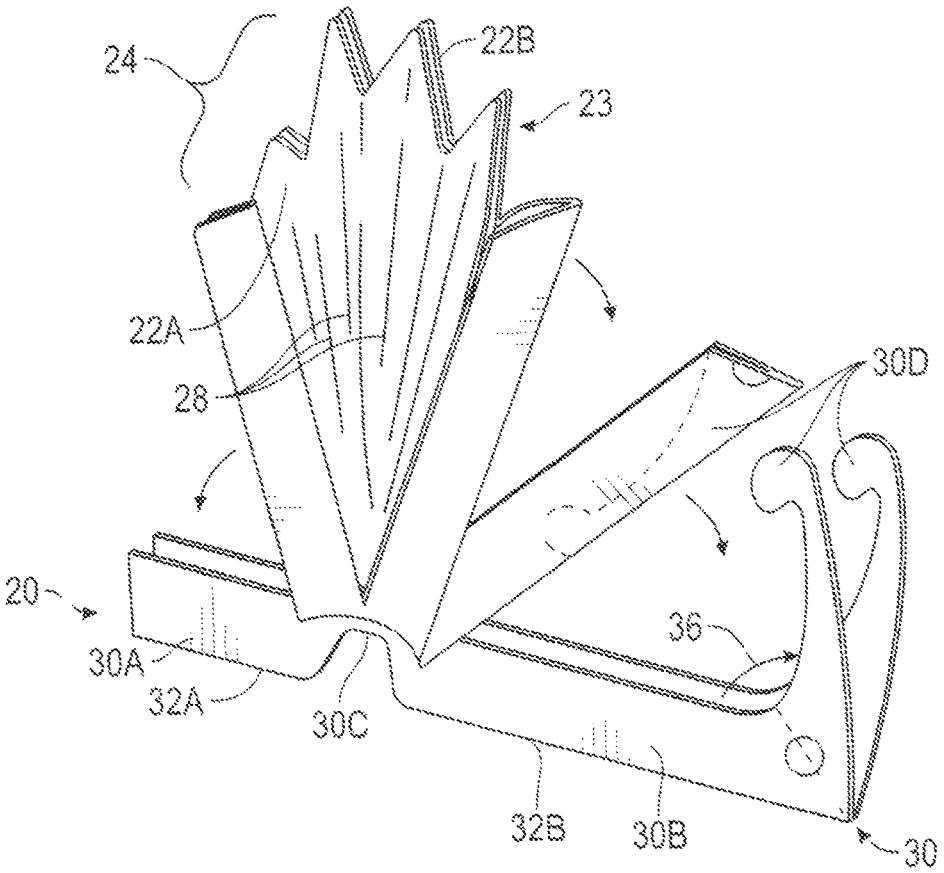
FIG. 1C is a perspective view of further unfolding stages according to the present invention embodiment of FIG. 1A.
Figure 1D:
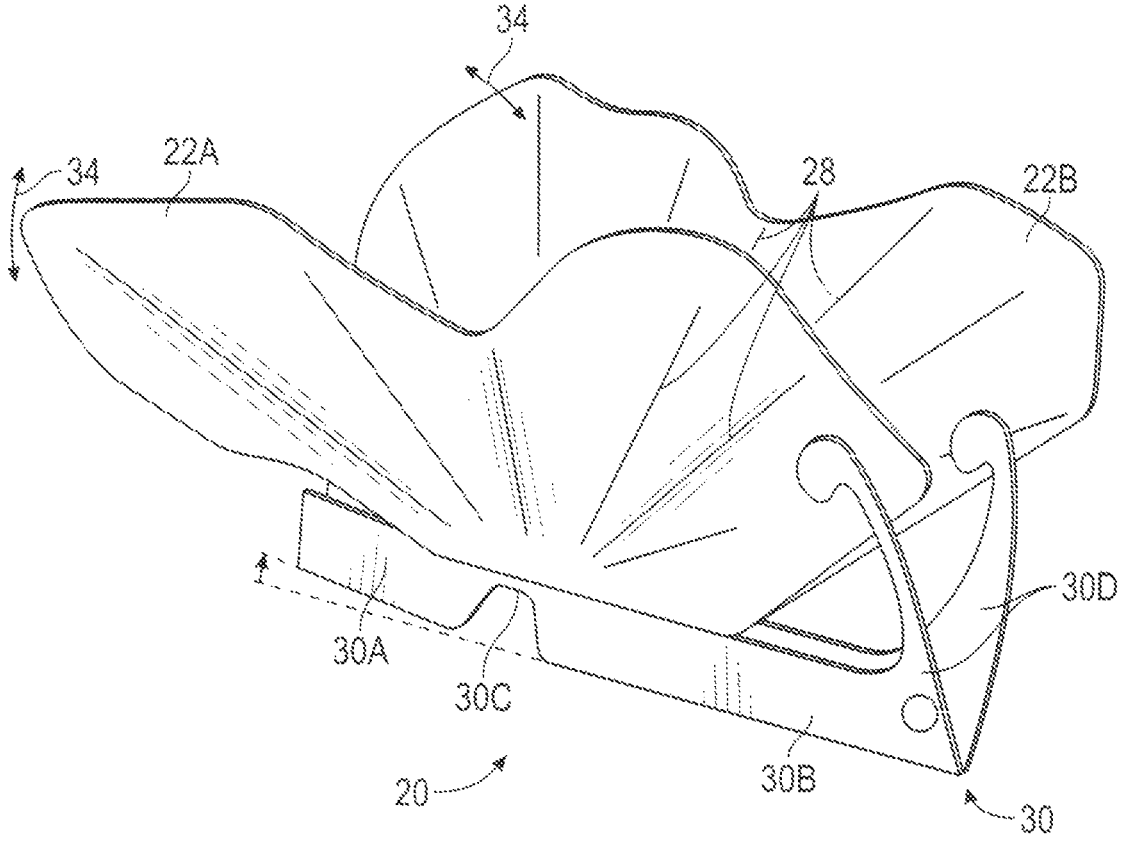
FIG. 1D is a perspective view of a raised-wing deployment according to the present invention embodiment of FIG. 1A.
Figure 1E:
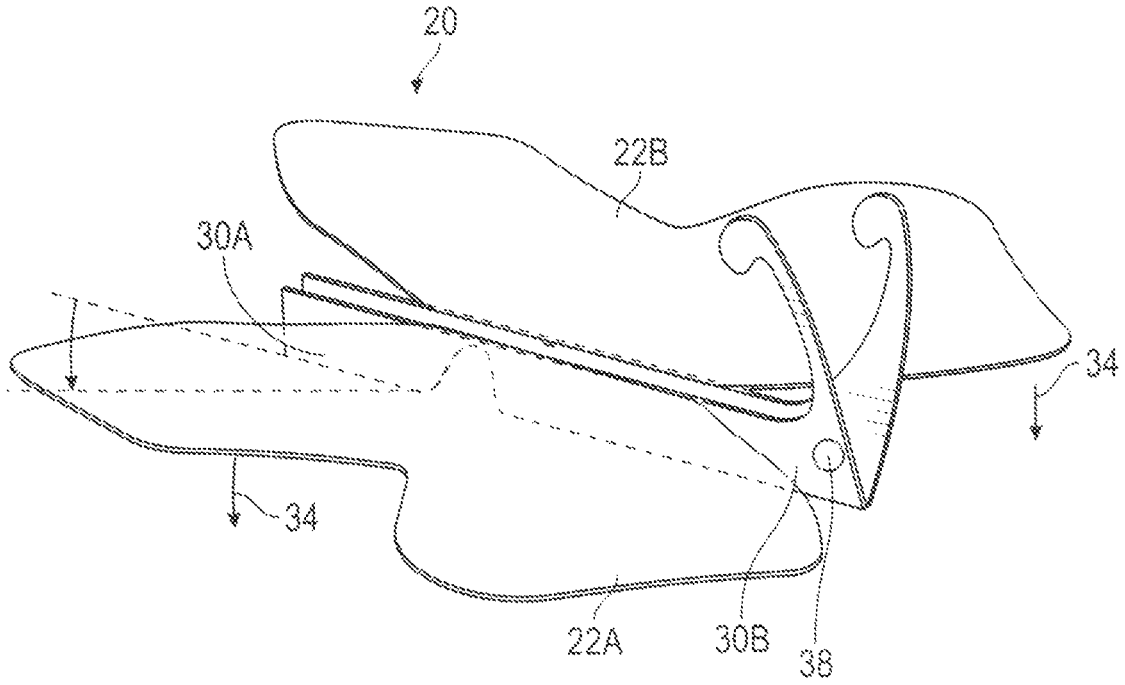
FIG. 1E is a perspective view of a lowered-wing deployment according to the present invention embodiment of FIG. 1A.

The un-foldable (and re-foldable) novel feature according to the present invention is shown in the sequence of FIGS. 1A, to 1D and 1E of a first embodiment 20. The mating accordion-folded wings 22A and 22B are folded in a nesting fan-like manner 23 allowing the ends 30A and 30B of the body support 30 to be folded about the narrowed connecting region 30C, to permit a desired size reduction while permitting wings to have structural support (due to the folds 28) when unfolded so as to emulate functional wings. Moreover, the body is also folded on the fold edges 32A and 32B for added support and control when the butterfly emulation is manipulated as discussed below. As shown in FIG. 1A, the end region 24 of the folded wing portion may be again folded to reduce the length of the embodiment 20, and unfolded as shown in FIG. 1B to permit unfolding of the wings 22A and 22B as shown in FIG. 1B, then FIG. 1C and ultimately FIGS. 1D and 1E. The connecting region 30C permits the body support 30 ends 30A and 30B to be moved relative to each other (e.g. the axis of edge 32A and 32B being moved out of alignment and in a plane in this embodiment) which effects a corresponding raising and lowering motion of the substantially unfolded wings 22A and 22B away from each other relative to the body support 30 out of said plane as shown in FIGS. 1D and 1E. Furthermore, decorative or further functional elements 30D may be attached to the body support, and may also be foldably stored within the body support 30 to be unfolded 36 as shown in FIG. 1C. Moreover, some or all of the various portions of the embodiment (e.g. 22A, 22B, 30) may further include decorative and/or instructive markings (e.g. 38) thereon.

A further novel feature relates to the ability for the user of the amusement device to create the emulation of a natural phenomenon in a manner analogous to the natural establishment (e.g. emergence from a compacted structure) of that phenomenon (e.g. a butterfly). In furtherance of that natural phenomenon, the user can move the wings 22A, 22B relative to each other to allow the user to interact with the amusement device and emulate butterfly wing motion 34 in the unfolded device. In the exemplary embodiment shown in FIGS. 1D and 1E, a user can grasp the portions 30A and 30B and move the axes (lengths) of each relative to each other to simulate the natural butterfly wing motion.

Figure 2:
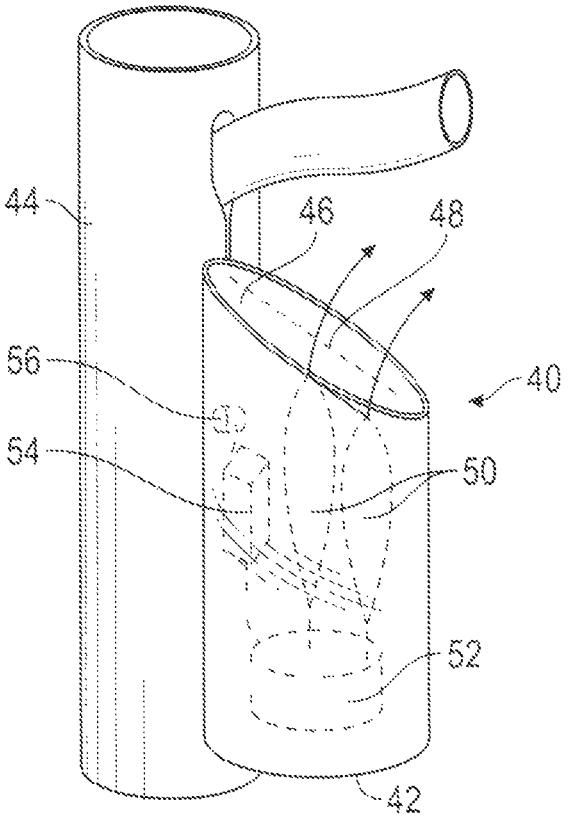
FIG. 2 is a perspective view of an alternate embodiment including a containing structure and two butterfly cocooned emulation structures.

Natural phenomenon such as butterfly emerge from a form typically contained prior to emergence as a butterfly, and the exemplary embodiment 40 of FIG. 2 provides a cocoon emulating structure, i.e. container 42 that may be supported on another object 44 (e.g. a tree or wall hook) and has an openable portion 46 with a selected rupturable portion thereof 48 (e.g. a thinned and/or weakened portion) through which the objects 50 of the natural phenomenon may emerge from the container 42.

As may be applied to the embodiment 40 of FIG. 2 and other embodiments, a further inventive feature may include a motive device that is connected to or part of the objects 50 and causes them to extend or to emerge from the container 42, and the motive device may comprise a releasable spring or other controllable motor. A controller 54 connected to the motive device 52 to cause, upon a sensed condition of the environment of the motive device, activation of the motive device to cause the objects 50 to emerge from the container 42, typically via portion 46. The environmental conditions sensed (e.g. by sensor 56) includes light, sound, temperature, etc. by a corresponding photo, acoustic, temperature, etc. sensor 56. According to one embodiment of the present invention, the activation of the motive device by controller 54 may be condition on a particular sequence or cycle of the sensed natural environment, e.g. the number and/or depth of cycles of light and dark, or of a temperature range, or of a sensed sequence of sounds (e.g. a song or a birdcall) as recorded or programmed into the controller 54.

Figure 3A:
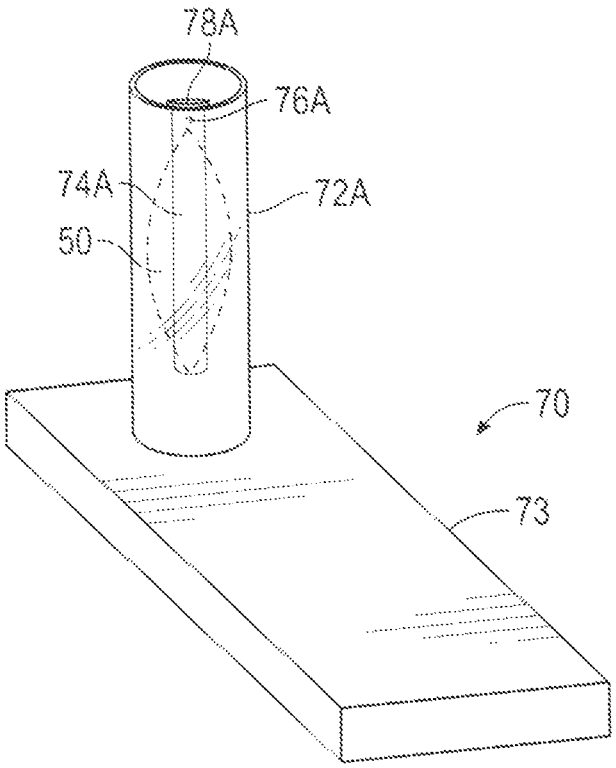
FIG. 3A is a perspective view of a further alternate embodiment providing an unopened containing structure.
Figure 3B:
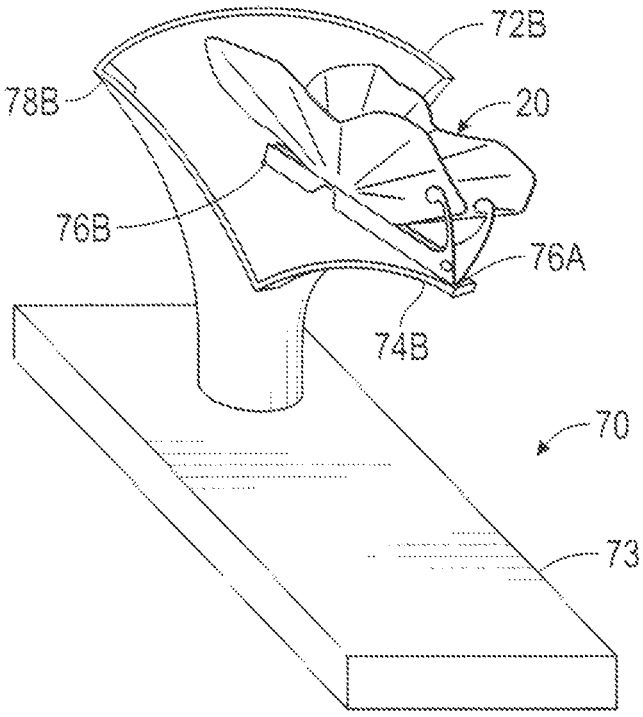
FIG. 3B is a perspective view of the embodiment of FIG. 3A showing the containing structure opened and the butterfly emulation deployed.

A further embodiment 70 is shown in FIGS. 3A and 3B, wherein the container comprises a tubular member shown 72A in a closed (undeployed) form and in an opened form 72B of FIGS. 3A and 3B, respectively, mounted on a supporting base 73. An openable portion 74A of the container 72A is shown as enclosing the natural emulation object 50 within the container 72A, and is shown revealing and supporting the object 50 in FIG. 3B, and may comprise a portion of the container having weakened margins to permit manual user access and separation from the container 72A, and it may also include a resilient spring like material (and optionally connected to or supported by connections 76A, 76B) which urges to the deployed position if portion 76A is released from within the container 72A by a release mechanism 78A, that may be manually activated or connected to the controller 54 of FIG. 2. The container 72A, 72B may also contain resilient material to provide an opening allowing object 50 to be revealed or emerge through an opening in the container 72A, 72B. The nature emulation object 50 may comprise a deployed or unfolded object 20.

Figure 4A:
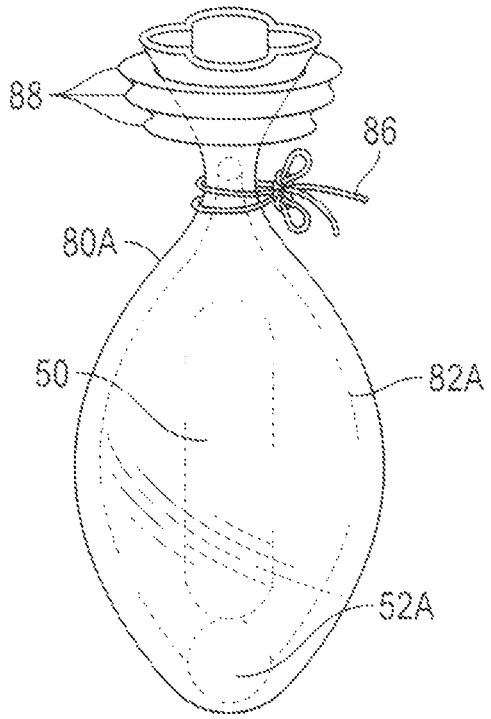
FIG. 4A is a perspective view of a further alternate embodiment showing the butterfly chrysalis emulation contained in soft cover in a soft outer sack.
Figure 4B:
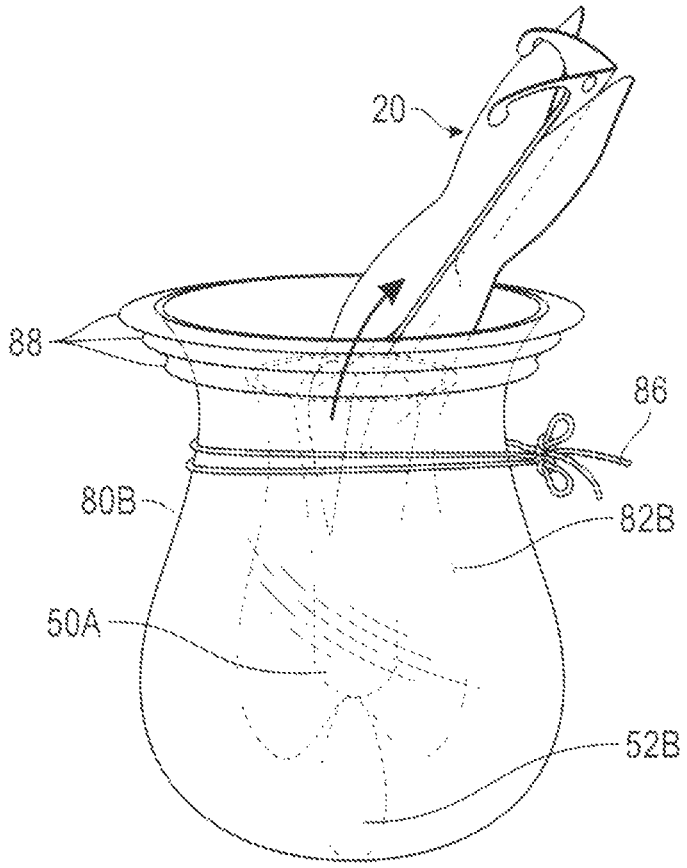
FIG. 4B is a perspective view of the embodiment of FIG. 4A showing the butterfly emerging from the soft outer sac.

A soft enclosed closed and open alternate embodiment is shown in FIGS. 4A, 4B, respectively, wherein the natural emulation object 50 is covered by an optional inner liner as an emulation of an inner chrysalis cover shown closed as 82A and open-ended as 82B. An outer soft closed sack 80A and open-ended sack 80B provides an outer covering that may be secured closed by a string 86 or other closure. The sack open end may include folds 88 or other structures for decoration or structural purpose to improve the natural emulation of the structure and use. The object may reside in the closed sack 84A and manually removed by the user and unfolded to provide the emulated natural phenomenon 20, or by an optional motive device 52A, may be activated 52B to eject the object 50A by user activation or control by a controller 54 et al. as previously described or upon opening of the string 86 or other closure.

The present invention is not limited to the butterfly amusement structure or device embodiments or processes show. Further modifications and substitutions by one of ordinary skill in the art are within the scope of the present invention, which is not to be limited except by the claims which follow.

What is claimed is:

1. An amusement device, comprising:

a body member having a first support end and a second support end extending substantially in the same first direction, and a flexible connecting region connecting said first support end and said second support end substantially along said first direction and flexible to permit said first region and said second region to extend along different directions; and a wing member attached to said body member first support end region and said body member second support end region and disposed to provide angular wing member movement relative to said body member upon flexure of saki flexible connecting region to effect a corresponding raising and lowering motion of a substantially unfolded wing member relative to said body member said first and said second support.

2. The amusement device of claim 1, further comprising a second wing connected to said body member first region and said body member second region.

3. The amusement device of claim 1, wherein said wing comprises a folded wing.

4. The amusement device of claim 3, wherein said folded wing comprises a double folded wing having 2 facing wings separable and movable away from each other when said body member first support and said body member second support are moved at said flexible connecting region.

5. The amusement device of claim 1, wherein said body member comprises a folded body member.

6. The amusement device of claim 1, further comprises a container receiving therein at least one body member and attached wing member.

7. The amusement device of claim 6, wherein said container comprises a cocoon emulating structure having a rupture portion thereof capable of selective rupture.

8. The amusement device of claim 7, wherein said rupture portion is at least one type comprising one of a thinned portion, a weakened portion, and a openable portion.

9. The amusement device of claim 7, wherein said rupture portion includes a resilient spring like material.

10. The amusement device of claim 6 wherein said containing structure comprises a sack.

11. The amusement device of claim 6, further including an inner chrysalis cover emulation within said containing structure.

12. The amusement device of claim 6, further including a motive device to urge said body member out of said containing structure.

13. The amusement device of claim 12 further including a motive device controller connected to said motive device to selectively activate said motive device to urge said body member.

14. The amusement device of claim 13, further including a condition sensor connected to said motive device controller to sense at least one of the type of a condition comprising a light, a sound, and a temperature condition.

15. The amusement device of claim 14, wherein said emerging means controller to selectively activate said emerging means upon a sequence or cycle of the sensed natural environment.

16. An amusement device, comprising:

an amusement object;

an amusement object container receiving said amusement object therein, and further comprising an openable portion;

a motive device connected to said amusement device to provide movement thereof;

an environmental condition sensor responsive to at least one environmental condition in which said amusement object container exists; and a controller connected to said environmental sensor and to said motive device, to cause, upon the occurrence of a selected sequence or cycles of a sensed environmental condition, said motive device to move said amusement object to exit said object container via said openable portion.

* * * * *